US005653065A

United States Patent [19]

McIlwain

[11] Patent Number: 5,653,065

[45] Date of Patent: Aug. 5, 1997

[54] METHOD AND APPARATUS FOR PROMOTING SOCIAL INTERCOURSE

[76] Inventor: Russell L. McIlwain, 3009 Grant St., Oak Brook, Ill. 60521

[21] Appl. No.: 597,360

[22] Filed: Feb. 8, 1996

[51] Int. Cl.[6] ..... E04B 1/346

[52] U.S. Cl. ..... 52/65; 52/7

[58] Field of Search ..... 52/6, 7, 29, 31, 52/65, 9; 472/36, 37, 43, 91

[56] References Cited

U.S. PATENT DOCUMENTS 2,764,783 10/1956 Teller ..... 52/65

2,815,539 12/1957 Schneider ..... 52/31

*Primary Examiner*—Creighton Smith

[57] ABSTRACT

A method and apparatus for promoting social intercourse among people comprises a system of ring-like or annular floor assemblies supported for concentric rotation relative to one another. The system is designed for use in a bar, club or restaurant wherein people may be seated on the movable floor assemblies. Preferably the floor assemblies of adjacent rings are counter-rotatable relative to one another. Thereby, as people pass one another on adjacent floor assemblies, they can casually initiate a meeting discourse exchange in a convenient and nonthreatening manner. People who meet and desire to further consummate the relationship may thereafter move to stationary seating in the room.

13 Claims, 2 Drawing Sheets

METHOD AND APPARATUS FOR PROMOTING SOCIAL INTERCOURSE

BACKGROUND OF THE INVENTION

1. Field of the Invention

The present invention relates generally to a method and apparatus for promoting social intercourse among people, and it relates more particularly to a method and means for people to meet and develop interpersonal relationships in a casual, nonthreatening and convenient manner.

2. Description of the Prior Art

Since time immemorial people have practiced associating with other people for purposes of perpetuating the survival of the species, among other things. It is a basic instinctual need of people, particularly those of opposite sexes, to meet and develop interpersonal relationships with others, to mate at some point and thereafter have offspring. Even people of the same sex enjoy social intercourse among themselves as a normal part of enhancing the quality of life. Man is basically a social creature.

Meeting people, whether of the opposite or even of the same sex can often be a difficult and frustrating experience, particularly in situations where a person feels a strong need in his or her life to find someone to become acquainted or otherwise associated with. In the early years of life in most modern societies the educational system provides a natural vehicle for people to associate with a variety of other people thereby satisfying the need for communalism because of the common interests shared by the members of the group. However, as time goes on and the person leaves academia to embark into the work place and make a living the numbers of opportunities to meet others and develop interpersonal relationships often diminishes dramatically. Social intercourse in the work place has resulted in promoting interpersonal relationships among people leading to mating and procreation. However, many people find it awkward to have both a business and personal relationship, at the same time, with someone at their place of employment. Indeed, in recent times it is dangerous from a legal standpoint to have more than a business relationship with someone at work because of implications related to possible sexual harassment claims should the personal relationship fail motivating one of the parties to seek retribution or reprisal against the other. This is true not only in heterosexual relationships but homosexual relationships as well. Failed relationships at work can ruin careers, cost considerable expense to people in both monetary and emotional terms and otherwise detract considerably from the quality of life. Accordingly, many people prefer to look outside the work place to develop interpersonal relationships with others.

To satisfy the need for communalism in the lives of people many vehicles for promoting interpersonal relationships have emerged. One such vehicle is a club or organization of some type where people who share common interests can become acquainted. Even established religious institutions offer programs for people to become acquainted and share common interests consistent with the practices of the particular religious faith. However, a disadvantage of such organized programs is that they appeal to persons who have relatively focused, established beliefs and often they are not attended by enough variety of people to permit practical permanent relationships to develop. Accordingly, vehicles for developing relationships have evolved which appeal to wider varieties of people thereby increasing the statistical odds of two people forming a relationship. One such vehicle is computer dating, which is a phenomenon wherein people under a degree of anonymity can become acquainted gradually and thereafter make conscious decisions whether they wish to get more seriously involved. This type of approach has an appeal particularly to people who are not involved already in a serious relationship but wish to start one. People in this class are often single people who do not have a spouse for one reason or another.

While computer dating has served a valuable function in getting people acquainted it is not without disadvantages. First, it is an expensive proposition to subscribe to a computer dating service. These services do screen the parties in an attempt to match common interests. However, the vagaries of personal relationships are such that people often do not know how to articulate what makes them attracted to other people. Thus, these services cannot ensure a successful match and often the subscriber to the service must spend a good deal of time and resources to find an acceptable acquaintance. This is particularly true of people such as singles who are advanced in years and who, through life experiences, have become less open to beliefs and concepts which are foreign to their own.

In order to expedite the process of becoming acquainted with others some people place advertisements in newspapers or other publications which have wide circulation and offer the possibility of exposing the advertising party to responses from numerous potential acquaintances. This method offers the advantages of relatively low-cost exposure and a degree of anonymity or privacy. However, the advertising party is completely left to his or her own resources and social acumen in discriminating whether to pursue a relationship with a responding party. Moreover, a small ad in a newspaper simply cannot condense the myriad of interests a person has as a result of his or her life experiences. Accordingly, the potential for an appropriate match is often not statistically realistic. Moreover, people generally like to visually examine their potential acquaintances at an early opportunity as part of the normal discrimination process. The process of examining a respondent to a personal newspaper ad can be a shocking and uncomfortable experience.

Yet another vehicle for promoting and developing interpersonal relationships has evolved with the evolution of information technology; that is computer chat lines. On a chat line a party can be completely anonymous while he or she monitors the line and verbally interacts with other subscribers. Then, if a responding party is interesting enough to get further involved with, the party can gradually let down his or her guard and divulge more personal information which could lead to a desired serious relationship. However, a known disadvantage of computer chat lines is that still limited numbers of people own computers. Even further, those who subscribe to these chat lines often are separated by considerable distance making it very geographically undesirable for people to become further associated. In this connection, a serious interpersonal relationship among normal people often leads to the desire for some sort of physical touching or the like. The inability to visually examine the other person is also considerably undesirable with chat lines. Accordingly, computer chat lines still have not fully met and satisfied the need people have to meet and form relationships with others.

One time-honored way for people to meet and become acquainted with others is to simply go to the bar. Bars are available in all different sizes, ambiances and the like. An advantage of a bar is that people who go there are likely to be domiciled in the same local area and are not only geographically desirable they are likely to share common attitudes, social values, lifestyles and so forth. A further advantage of a bar is that these establishments often serve alcohol in some form which can be an aphrodisiac and allow people to become less inhibited than they normally would be. The result is that bars serve a highly functional purpose in presenting opportunities for people to meet and become acquainted. As a consequence bars have been highly successful in promoting mating, procreation and the like among not only single people but even among people who have other serious relationships which are lacking in some respect or are not entirely satisfying. A considerable advantage of a bar as a setting for meeting people is that people can, at the very outset, visually examine other people and make an early determination of whether they wish to initiate a relationship based upon sensuality and other related attributes which are frequently a basic part of human relations.

A known disadvantage of bars as a place for meeting people is that situations can develop in the process of people meeting other people which are uncomfortable to deal with. This is particularly true in bars where people are fairly mobile and have relative ease in moving about the bar room to mingle with others. A situation can develop, for example, in which an aggressive person approaches another more reserved person and attempts to dominate an initial meeting contact. In such a situation, the reserved person may not wish to be engaging by advancing the relationship and hence might wish to extricate himself or herself from the situation. But, because of the physical layout of the bar and the desire to not be discourteous or rude that person may feel trapped in an uncomfortable position with the only alternative being to leave the bar at the sacrifice of having a potentially good experience meeting other people. In a somewhat opposite situation where the bar is not conducive to mingling, one person may feel too bashful or timid to walk over to another person to start an initial meeting contact for fear that the respondent will reject the advance. Fear of rejection is a known psychological impediment to people approaching others to make initial contact. In a bar situation a person may feel subject to ridicule if he or she is rejected or dejected by another person in the clear view of onlookers. Accordingly, while many bars attempt to provide an atmosphere and ambiance for people to readily meet other people they still are not without limitations in bringing people together in a convenient, nonthreatening and effective manner.

It is, therefore, desirable to provide a method and means for people to readily meet other people in a convenient, nonthreatening and casual manner. It is further desirable to provide such a method and means which is conducive to bringing people together who have potentially common interests and lifestyles. Still further it is desirable to provide such a method and means wherein people have relatively rapid and large exposure to others and hence have the ability to pick and choose others for purposes of initiating a meeting contact in a discriminating but comfortable manner.

SUMMARY OF THE INVENTION

The present invention overcomes the disadvantages of the prior art by providing a system of generally annular floor panels supported for concentric rotation one about another and wherein the panels support suitable tables and chairs for people to occupy. Preferably the panels of adjacent rings or annuli are counter rotating relative to one another. Thereby people positioned on the rings move past people positioned or adjacent rings and have an opportunity if they wish to initiate an initial meeting contact with people passing by on an adjacent ring. The system is most suitable for use in a bar where stationary seating means may also be provided for people to segue to should an initial contact result in the desire of people to further advance the relationship more quickly by leaving the ring apparatus.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
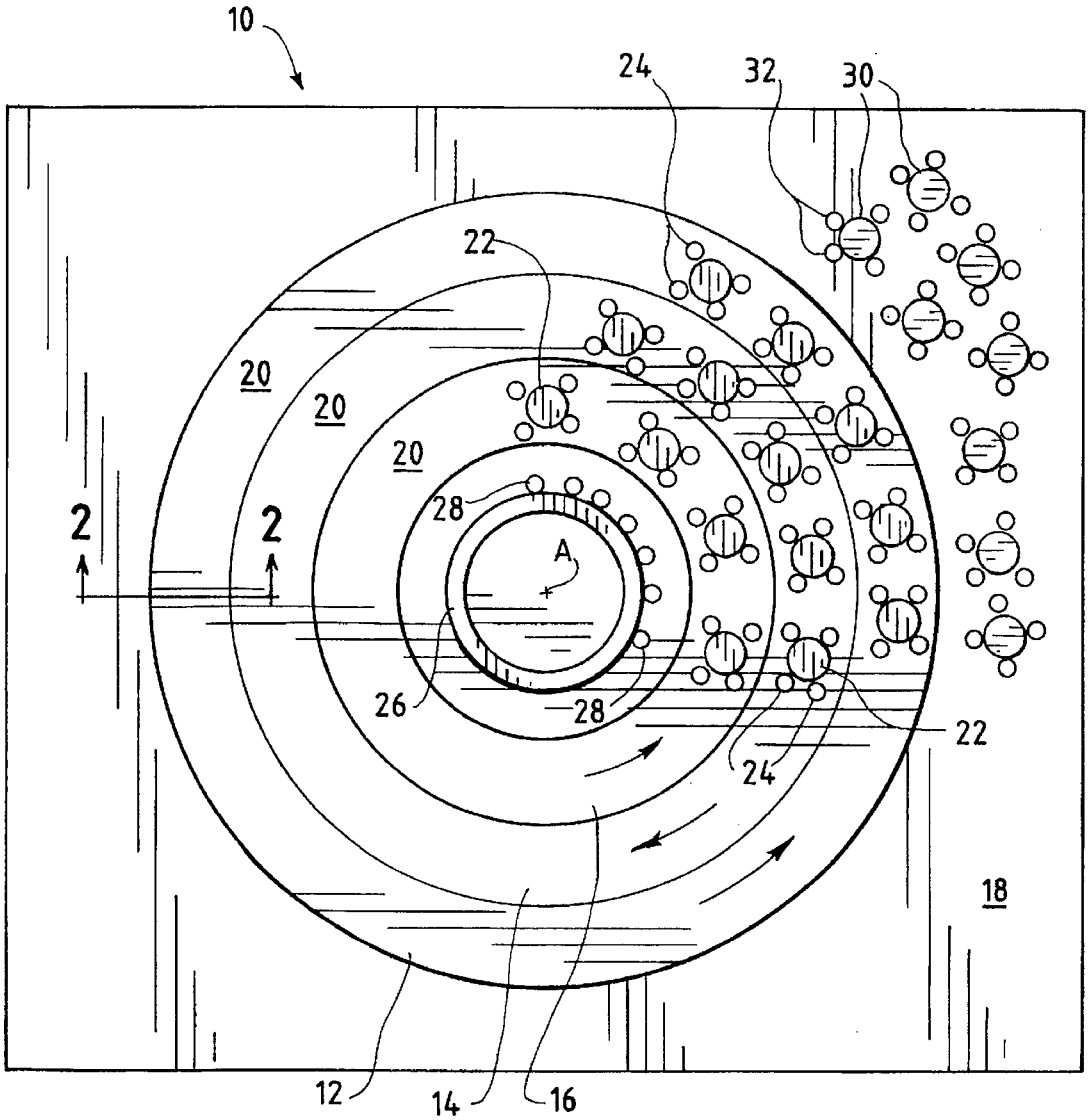
FIG. 1 is a schematic view, in plan, of a system for promoting social intercourse among people constructed in accordance with one form of the invention.

Referring now to the drawings, and initially to FIG. 1, a system for promoting social intercourse among people is illustrated schematically and designated generally by the reference numeral 10. The system 10 comprises as its principal components an arrangement of annular ring-like floor assemblies 12, 14 and 16 positioned concentrically with their respective centers of curvature all coincident at a common central axis A. The assemblies 12, 14 and 16 are supported on a stationary floor 18 of a room which may, for example, be a concrete slab. The floor 18 is preferably smooth and level.

In accordance with the invention, and as will be described in detail hereinafter, the floor assemblies 12, 14 and 16 comprise a series of floor panels 20 arranged in closely spaced relation with respect to the panels 20 of adjacent floor assemblies 12, 14 and 16. The panels 20 have sufficient strength to support suitable tables 22 and associated chairs or stools 24. Thereby, people may be seated at the tables 22, as in a conventional restaurant, club or bar, and may be served food and beverages. In one form of the invention, the floor assemblies 12, 14 and 16 are designed to be counter-rotating. The system 10 may also include a stationary service bar 26 with associated stools 28 disposed centrally of the movable floor assemblies 12, 14 and 16. Also, additional tables 30 and chairs 32 may be placed outside the floor assemblies 12, 14 and 16 on the stationary floor 18.

Figure 2:
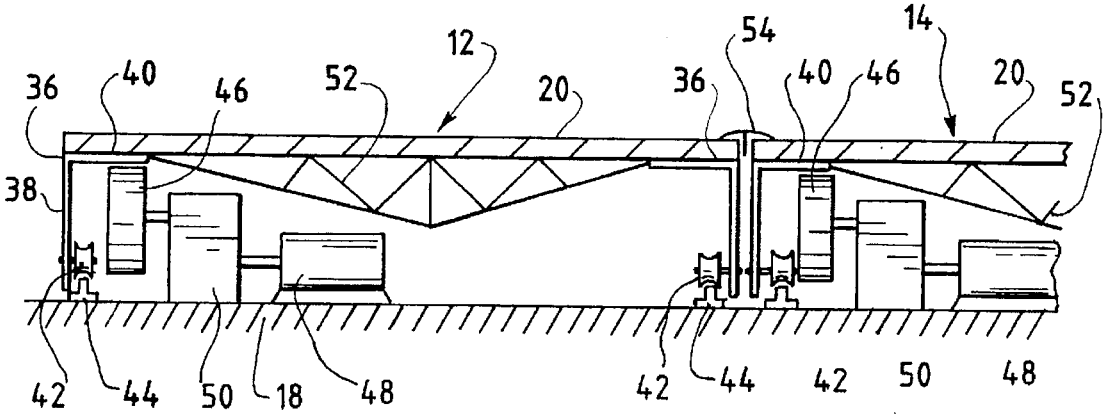
FIG. 2 is a partial cross-sectional view of one form of a floor assembly in accordance with the invention taken substantially along the line 2—2 of FIG. 1.

Turning now to FIG. 2, a typical cross-section of the assemblies 12 and 14 is illustrated showing floor panels 20 secured at their edges to angle braces 36. Preferably the braces 36 are steel members defining a skirt portion 38 extending downwardly at a right angle to a support plate portion 40. In this first form of the invention the floor assemblies 12 and 14 are supported on the floor 18 by a plurality of rollers 42 fixed for free rotation on the skirt portions 38 of the braces 36 and configured to ride on rails 44. The plate portions 40 of the braces 40 not only support the floor panels 20, but they also serve as bearing surfaces for drive wheels 46. The drive wheels 46 are driven by motors 48 and gear reduction systems 50. Thus each assembly 12 and 14 is independently rotatable about the central axis A of the system 10. Suitable tresses 52 may be fixed to the undersides of the panels 20 at regular spaced intervals to reinforce the panels 20. A molding strip 54 may also be provided to cover the space between panels 20 of adjacent floor assemblies 12 and 14 and prevent debris from falling between the panels 20.

Figure 3:
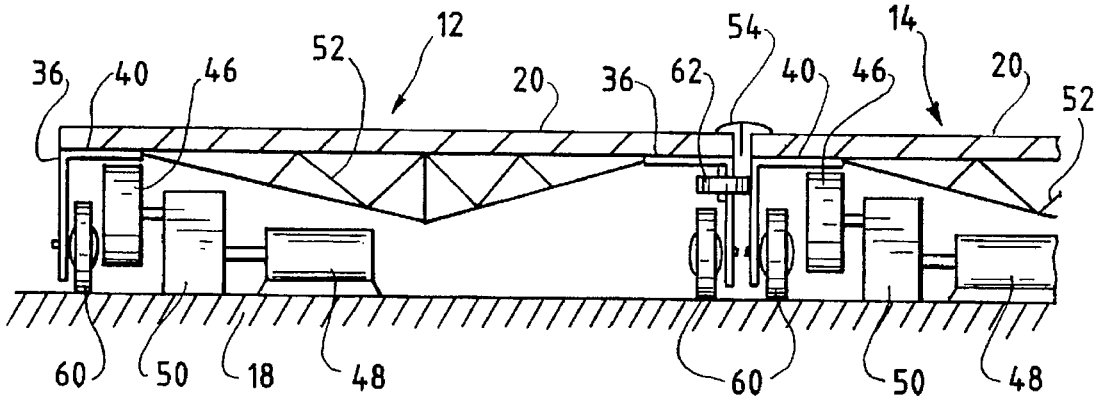
FIG. 3 is a partial cross-sectional view of a second form of a floor assembly in accordance with the invention taken substantially along the line 2—2 of FIG. 1.

In another form of the invention as illustrated in FIG. 3 the assemblies 12 and 14 are supported for rotational movement on the floor 18 without the need for fixed rails 44. Rather, wheels 60 are mounted for free rotation on the skirt portions 38 of the braces 36. To maintain the assemblies 12 and 14 in relative rotatable alignment, wheels 62 are mounted to selected skirt portions 38 of the braces 36 at spaced intervals along the braces 36. This form of the invention may be desirable for a less permanent system 10. Of course, in another form of the invention a single rail 44 may be used on one side of each assembly 12 or 14 with wheels 60 being used to support the other side of the assembly thereby eliminating the need for the alignment wheels 62.

It can now be appreciated that the system 10 in accordance with the invention provides a highly effective means for permitting people of common lifestyles and interests to meet and initiate relationships in a casual, nonthreatening and convenient manner. The ring assemblies 12, 14 and 16 can be driven, for example, as to counter-rotate at a rate of several feet per minute, allowing people situated on adjacent rings 12, 14 and 16 to initiate conversations if they wish. If adjacent parties are not interested in conversing for one reason or another, the parties can simply wait to pass one another and move on to other parties. Thus, parties do not find themselves trapped in potentially undesirable meeting experiences. Of course, if parties desire to more fully consummate an initial meeting they can agree to move to a stationary location such as at the bar 26 or at tables 30, as illustrated in FIG. 1. Moreover, those people who are somewhat timid about meeting others do not have to physically relocate from the moving locations 22 and 24. Essentially, other people come to them. The system 10 clearly provides an excellent means for parties to physically examine others before initiating a personal relationship. In addition, patrons of a bar or restaurant establishment can enjoy a continuously changing environment as they circulate around the room.

It can further be appreciated that although only one drive motor 48 and related gear reducer 50 and drive wheel 46 have been illustrated in FIGS. 2 and 3 for each floor assembly 12 and 14, in practice the assemblies 12, 14 and 16 will be driven by multiple motors 48 positioned at spaced intervals around the assemblies 12, 14 and 16. Moreover, the motors 48 are preferably of a variable speed type such that the rate of rotation of the assemblies 12, 14 and 16 may be adjusted to any desirable speed. Further, the assemblies 12, 14 and 16 can be manufactured in sectional form for convenient assembly on site by simply bolting the sections together. Although the system 10 illustrated in FIG. 1 comprises three annular floor assemblies 12, 14 and 16 movable about a central service bar 26, it can be appreciated that any number of ring assemblies may be used depending on the size of the location. Further, some rings may be stationary relative to the floor 18 of the room and also a circular floor either movable or stationary may replace the center service bar 26.

While the present invention has been described in connection with preferred embodiments thereof, it will be apparent to those skilled in the art that many changes and modifications may be made without departing from the true spirit and scope of the invention. Accordingly, it is intended by the appended claims to cover all such changes and modifications as come within the true spirit and scope of the invention.

What is claimed is:

1. Apparatus for promoting social intercourse among people comprising:

a first floor assembly including a floor panel member configured with a circular peripheral edge;

a second floor assembly including a floor panel member configured with a circular peripheral edge;

said floor panel members each defining a generally planar surface for supporting people thereon;

said floor assemblies being arranged with centers of curvature of the respective peripheral edges of said panel members being substantially coincident; and means for rotating each of said floor assemblies about an axis of rotation substantially coincident with said centers of curvature.

2. The apparatus of claim 1 wherein at least one of said floor assemblies is annular in shape.

3. The apparatus of claim 1 including means for rotating both floor assemblies about said axis of rotation with said floor assemblies movable in opposite directions of rotation.

4. The apparatus of claim 1 wherein said rotatable floor assemblies include rotating members journaled for rotation on said floor assemblies for supporting said floor assemblies for rotation on a stationary surface.

5. The apparatus of claim 1 wherein said rotating means includes a motor and said motor communicates with a drive assembly to rotate said floor assembly.

6. The apparatus of claim 1 wherein said rotating means includes a drive wheel and said drive wheel is in engagement with one of said floor assemblies.

7. The apparatus of claim 1 wherein at least one of said rotatable floor assemblies includes a skirt disposed along said peripheral edge and said skirt supports said panel member for rotation.

8. The apparatus of claim 1 wherein said planar surfaces of said panel members are disposed substantially in a common plane.

9. The apparatus of claim 1 including at least one circular rail and at least one of said rotatable floor assemblies is supported on said rail.

10. The apparatus of claim 1 including means for situating people on said floor assemblies.

11. The apparatus of claim 10 wherein said situating means includes tables and chairs.

12. A method for promoting social intercourse among people comprising the steps of:

providing a first floor assembly including a first floor panel member configured with a circular peripheral edge having a center of curvature, said assembly having means permitting rotational movement of said floor panel member about an axis coincident with the center of curvature of said peripheral edge;

providing a second floor assembly including a second floor panel member configured with a circular peripheral edge having a center of curvature substantially coincident with the center of curvature of the circular peripheral edge of said first floor panel member, said second assembly having means permitting rotational movement of said second floor panel member about said centers of curvature of said peripheral edges;

positioning said first floor assembly adjacent to said second floor assembly with said peripheral edges of said panels in spaced relation to one another;

providing means for situating people on both floor assemblies adjacent said peripheral edges; and rotating said floor assemblies wherein people situated on the first floor assembly are transported past people situated on the second floor assembly.

13. The method of claim 12 wherein said first and second floor assemblies are counter-rotating.

* * * * *